US006487807B1

(12) United States Patent
Kopman et al.

(10) Patent No.: US 6,487,807 B1
(45) Date of Patent: Dec. 3, 2002

(54) TRIPOD GUN HANDLE

(76) Inventors: Matt Kopman, R.R. 1 Box 45, Hazel, SD (US) 57242; Wally Brownlee, P.O. Box 773, Watertown, SD (US) 57201

( * ) Notice: Subject to any disclaimer, the term of this patent is extended or adjusted under 35 U.S.C. 154(b) by 0 days.

(21) Appl. No.: 09/810,064

(22) Filed: Mar. 16, 2001

(51) Int. Cl.[7] ..... F41A 29/00; F41C 27/00

(52) U.S. Cl. ..... 42/94; 42/72

(58) Field of Search ..... 42/94, 75.01, 72; 248/171, 170, 188.8, 188.6; 89/37.04, 14.2

(56) References Cited

U.S. PATENT DOCUMENTS

| | | | | | |
|---|---|---|---|---|---|
| 713,114 | A | * | 11/1902 | La Force | 135/66 |
| 721,425 | A | * | 2/1903 | Clyde | 248/171 |
| 1,184,078 | A | * | 5/1916 | Cooke | 42/118 |
| 1,593,415 | A | * | 7/1926 | Perkins | |
| 1,786,308 | A | * | 12/1930 | Latourelle et al. | 248/155 |
| 2,498,749 | A | * | 2/1950 | Benson | 42/71.01 |
| 2,826,848 | A | | 3/1958 | Davies | |
| 2,844,905 | A | * | 7/1958 | Musser et al. | 248/188.2 |
| 3,233,517 | A | | 2/1966 | Morrison | |
| 3,618,885 | A | * | 11/1971 | Muller | 211/196 |
| 3,632,073 | A | * | 1/1972 | Nakatani | 248/169 |
| 3,804,355 | A | * | 4/1974 | Uroshevich | 248/124.1 |
| 4,010,922 | A | * | 3/1977 | Heller et al. | 248/165 |
| 4,121,799 | A | | 10/1978 | Michio | |
| 4,215,839 | A | | 8/1980 | Gibran | |
| 4,317,552 | A | * | 3/1982 | Weidler | 211/203 |
| 4,455,005 | A | | 6/1984 | Mooney | |
| D276,621 | S | * | 12/1984 | Hanke | D16/244 |
| 4,545,660 | A | * | 10/1985 | Rudolf | 248/171 |
| 4,575,964 | A | * | 3/1986 | Griffin | 42/94 |
| 4,580,483 | A | | 4/1986 | Garbini | |
| 4,583,958 | A | * | 4/1986 | Matsuda | 124/27 |
| 4,695,022 | A | * | 9/1987 | Mendonsa et al. | 206/314 |
| 4,915,332 | A | * | 4/1990 | Ouellette | 211/172 |
| 4,974,802 | A | * | 12/1990 | Hendren | 248/181.1 |
| 5,029,407 | A | * | 7/1991 | Kirkpatrick | 42/94 |
| 5,048,215 | A | * | 9/1991 | Davis | 42/71.01 |
| 5,074,188 | A | * | 12/1991 | Harris | 42/94 |

(List continued on next page.)

*Primary Examiner*—Michael J. Carone
*Assistant Examiner*—Denise Buckley

(57) ABSTRACT

A tripod gun handle for providing a combination pistol grip and pivotal tripod. The tripod gun handle includes a mounting assembly designed for removably coupling to of a gun. A handle portion has a first end coupled to the mounting assembly. A plurality of legs are hingably coupled to a second end of the handle portion opposite the mounting assembly whereby each of the legs are positionable into a deployed position wherein each of the legs is designed for abutting a support surface for supporting the gun. The legs are positionable into a storage position for facilitating transportation of the gun. A leg locking assembly is coupled to the second end of the handle portion. The leg locking assembly is for selectively locking the legs in the deployed position and in the storage position defined by the legs being positioned within the handle portion.

35 Claims, 9 Drawing Sheets

U.S. PATENT DOCUMENTS 5,081,782 A * 1/1992 Wright ..... 42/94
5,082,222 A * 1/1992 Hsu ..... 248/170
5,142,806 A * 9/1992 Swan ..... 42/114
D335,889 S 5/1993 Gibran
5,310,145 A * 5/1994 Chen ..... 248/170
5,345,706 A * 9/1994 Brown ..... 42/94
5,354,024 A 10/1994 Vinghog et al.
5,402,595 A * 4/1995 Tamllos ..... 42/94
5,410,835 A * 5/1995 Vetter ..... 42/94
5,417,002 A * 5/1995 Guerra ..... 42/72
5,438,786 A * 8/1995 Hilderbrand ..... 248/171
5,584,137 A * 12/1996 Teetzel ..... 362/114
5,611,509 A * 3/1997 Kulp et al. ..... 248/171
5,628,135 A * 5/1997 Cady ..... 42/94
5,692,719 A * 12/1997 Shepherd ..... 248/188.7
5,694,712 A * 12/1997 Plonka ..... 42/124
5,713,553 A * 2/1998 Cooper ..... 248/170
5,758,448 A * 6/1998 Thummel ..... 362/114
5,806,228 A * 9/1998 Martel et al. ..... 42/124
5,937,560 A * 8/1999 Beltz ..... 42/94
5,946,842 A * 9/1999 Nyzell et al. ..... 42/72
6,007,032 A * 12/1999 Kuo ..... 248/125.1
6,055,760 A * 5/2000 Cuson et al. ..... 42/71.01
6,192,908 B1 * 2/2001 Smith ..... 135/65
6,283,421 B1 * 9/2001 Eason et al. ..... 248/170
6,315,251 B1 * 11/2001 Stoudt et al. ..... 248/156
6,315,256 B1 * 11/2001 Tolar ..... 248/230.4

* cited by examiner

TRIPOD GUN HANDLE

BACKGROUND OF THE INVENTION

1. Field of the Invention

The present invention relates to tripods and more particularly pertains to a new tripod gun handle for providing a combination pistol grip and pivotal tripod.

2. Description of the Prior Art

The use of tripods is known in the prior art. More specifically, tripods heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,121,799; 2,826,848; 3,233,517; 4,580,483; 5,354,024; 4,215,839; 4,455,005; and U.S. Pat. No. Des. 335,889.

While these devices fulfill their respective, particular objectives and requirements, the aforementioned patents do not disclose a new tripod gun handle. The inventive device includes a mounting assembly designed for removably coupling to of a gun. A handle portion has a first end coupled to the mounting assembly. The handle portion is designed for being gripped by a hand of a user when the mounting assembly is coupled to the gun. The handle portion is designed for stabilizing the barrel of a gun when the hand of the user grips the handle portion. A plurality of legs are hingably coupled to a second end of the handle portion opposite the mounting assembly whereby each of the legs are positionable into a deployed position wherein each of the legs is designed for abutting a support surface for supporting the gun. The legs are positionable into a storage position for facilitating transportation of the gun. A leg locking assembly is coupled to the second end of the handle portion. The leg locking assembly is for selectively locking the legs in the deployed position and in the storage position defined by said legs being positioned within the handle portion.

In these respects, the tripod gun handle according to the present invention substantially departs from the conventional concepts and designs of the prior art, and in so doing provides an apparatus primarily developed for the purpose of providing a combination pistol grip and pivotal tripod.

SUMMARY OF THE INVENTION

In view of the foregoing disadvantages inherent in the known types of tripods now present in the prior art, the present invention provides a new tripod gun handle construction wherein the same can be utilized for providing a combination pistol grip and pivotal tripod.

The general purpose of the present invention, which will be described subsequently in greater detail, is to provide a new tripod gun handle apparatus and method which has many of the advantages of the tripods mentioned heretofore and many novel features that result in a new tripod gun handle which is not anticipated, rendered obvious, suggested, or even implied by any of the prior art tripods, either alone or in any combination thereof.

To attain this, the present invention generally comprises a mounting assembly designed for removably coupling to of a gun. A handle portion has a first end coupled to the mounting assembly. The handle portion is designed for being gripped by a hand of a user when the mounting assembly is coupled to the gun. The handle portion is designed for stabilizing the barrel of a gun when the hand of the user grips the handle portion. A plurality of legs are hingably coupled to a second end of the handle portion opposite the mounting assembly whereby each of the legs are positionable into a deployed position wherein each of the legs is designed for abutting a support surface for supporting the gun. The legs are positionable into a storage position for facilitating transportation of the gun. A leg locking assembly is coupled to the second end of the handle portion. The leg locking assembly is for selectively locking the legs in the deployed position and in the storage position defined by said legs being positioned within the handle portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new tripod gun handle apparatus and method which has many of the advantages of the tripods mentioned heretofore and many novel features that result in a new tripod gun handle which is not anticipated, rendered obvious, suggested, or even implied by any of the prior art tripods, either alone or in any combination thereof.

It is another object of the present invention to provide a new tripod gun handle which may be easily and efficiently manufactured and marketed.

It is a further object of the present invention to provide a new tripod gun handle which is of a durable and reliable construction.

An even further object of the present invention is to provide a new tripod gun handle which is susceptible of a low cost of manufacture with regard to both materials and labor, and which accordingly is then susceptible of low prices of sale to the consuming public, thereby making such tripod gun handle economically available to the buying public.

Still yet another object of the present invention is to provide a new tripod gun handle which provides in the apparatuses and methods of the prior art some of the advantages thereof, while simultaneously overcoming some of the disadvantages normally associated therewith.

Still another object of the present invention is to provide a new tripod gun handle for providing a combination pistol grip and pivotal tripod.

Yet another object of the present invention is to provide a new tripod gun handle which includes a mounting assembly designed for removably coupling to of a gun. A handle portion has a first end coupled to the mounting assembly. The handle portion is designed for being gripped by a hand of a user when the mounting assembly is coupled to the gun. The handle portion is designed for stabilizing the barrel of a gun when the hand of the user grips the handle portion. A plurality of legs are hingably coupled to a second end of the handle portion opposite the mounting assembly whereby each of the legs are positionable into a deployed position wherein each of the legs is designed for abutting a support surface for supporting the gun. The legs are positionable into a storage position for facilitating transportation of the gun. A leg locking assembly is coupled to the second end of the handle portion. The leg locking assembly is for selectively locking the legs in the deployed position and in the storage position defined by said legs being positioned within the handle portion.

Still yet another object of the present invention is to provide a new tripod gun handle that provides a removable pistol grip for a gun to help stabilize the gun while firing.

Even still another object of the present invention is to provide a new tripod gun handle that provides a pistol grip having a tripod for stabilizing the gun on a support surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
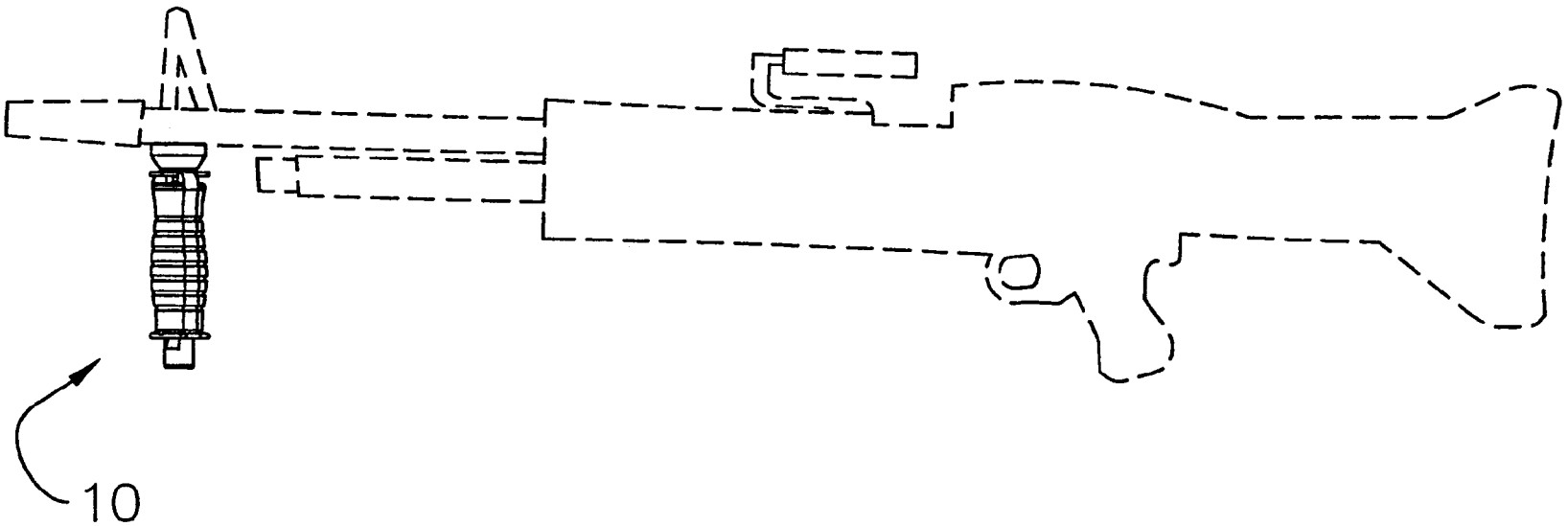
FIG. 1 is an elevational view of a new tripod gun handle according to the present invention in use.
Figure 2:
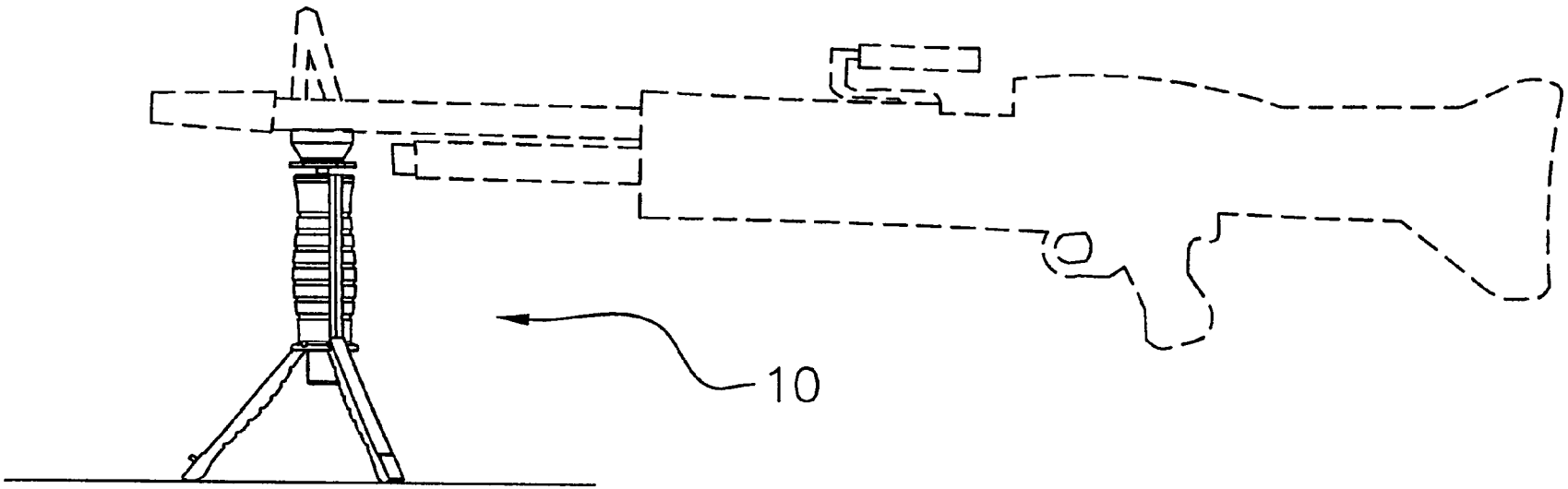
FIG. 2 is an elevational view of the present invention in use with the legs in the deployed position.
Figure 3:
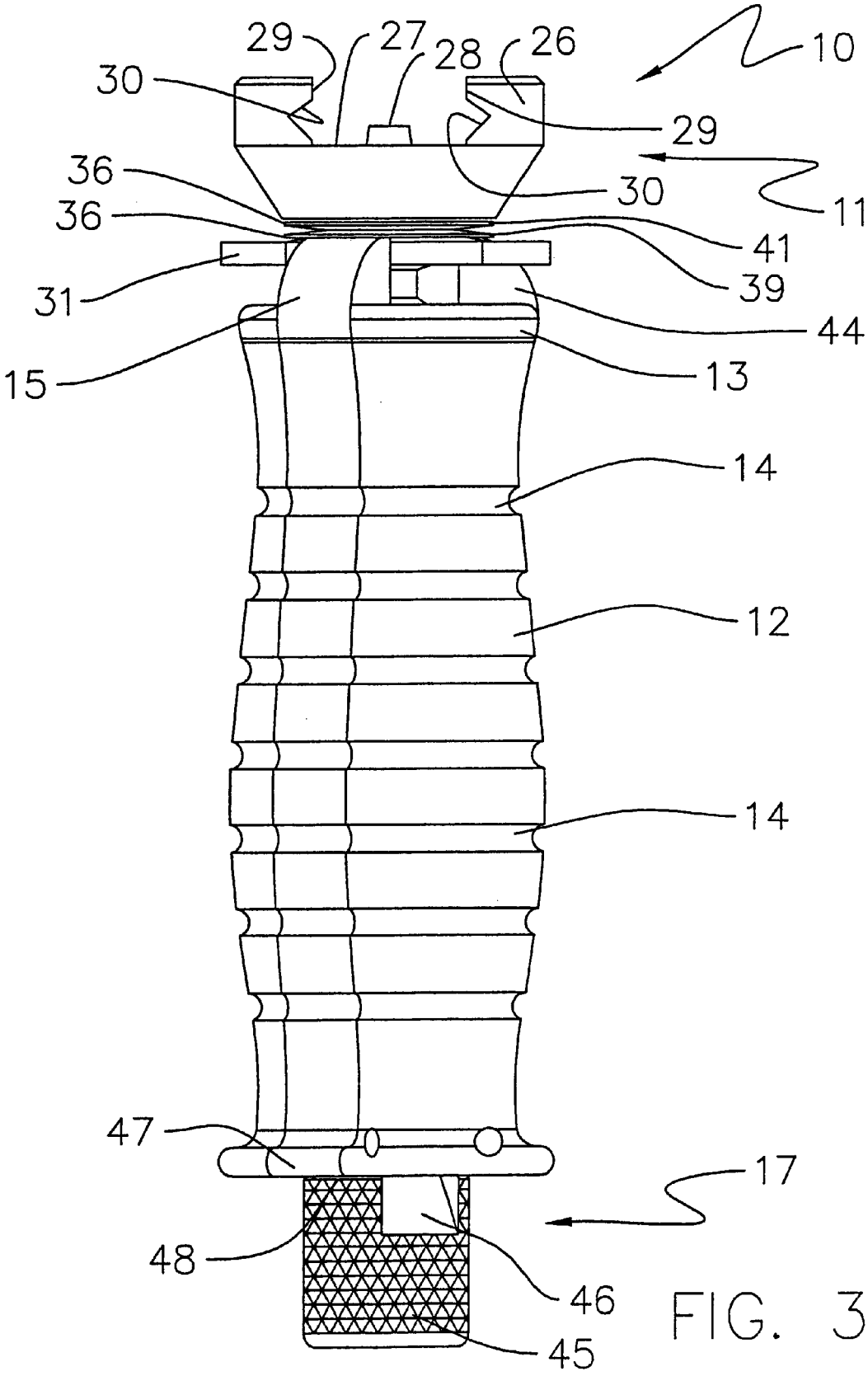
FIG. 3 is an elevational view of the present invention with the legs in the stored position.
Figure 4:
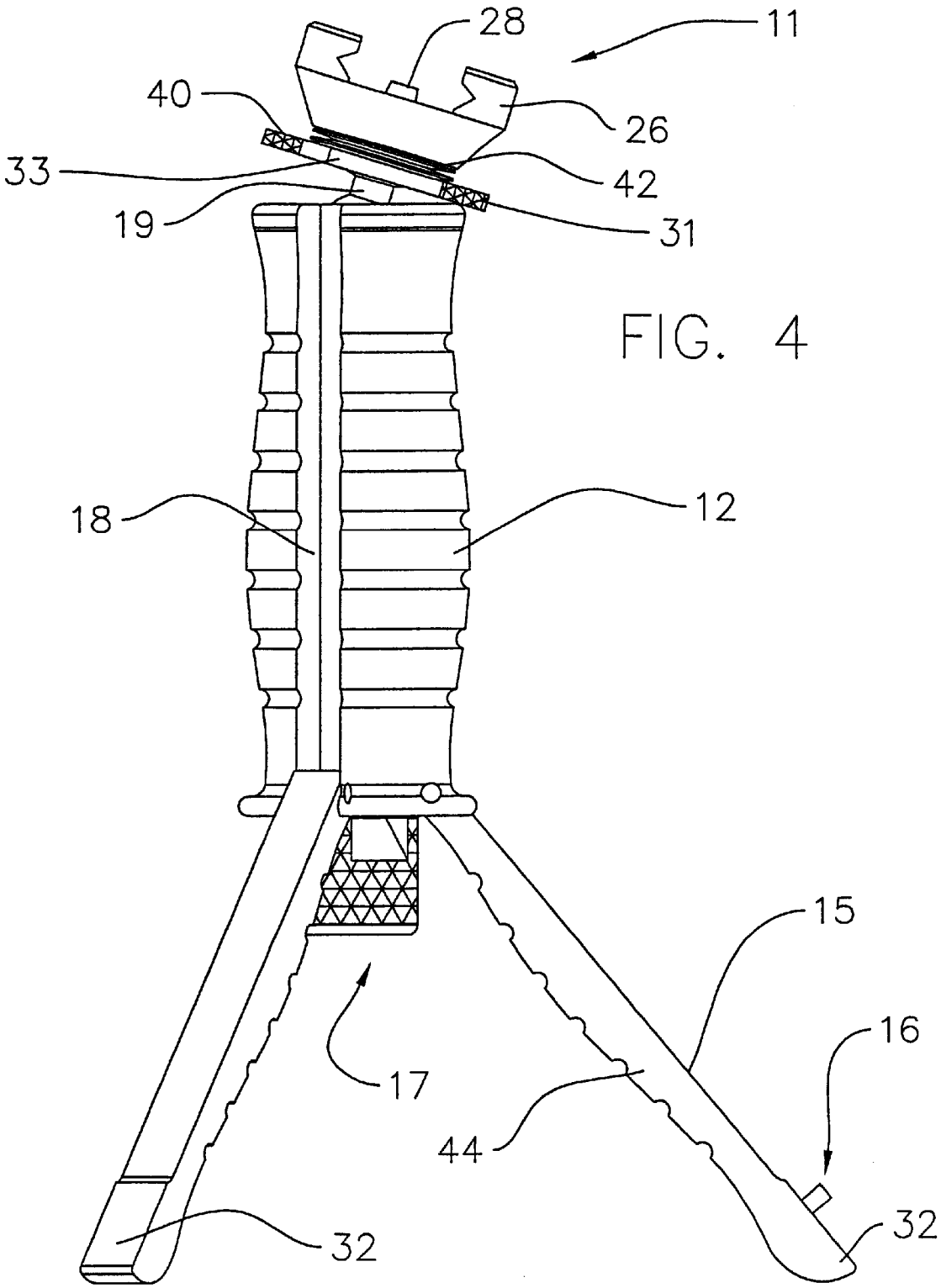
FIG. 4 is an elevational view of the present invention with the legs in the deployed position.
Figure 5:
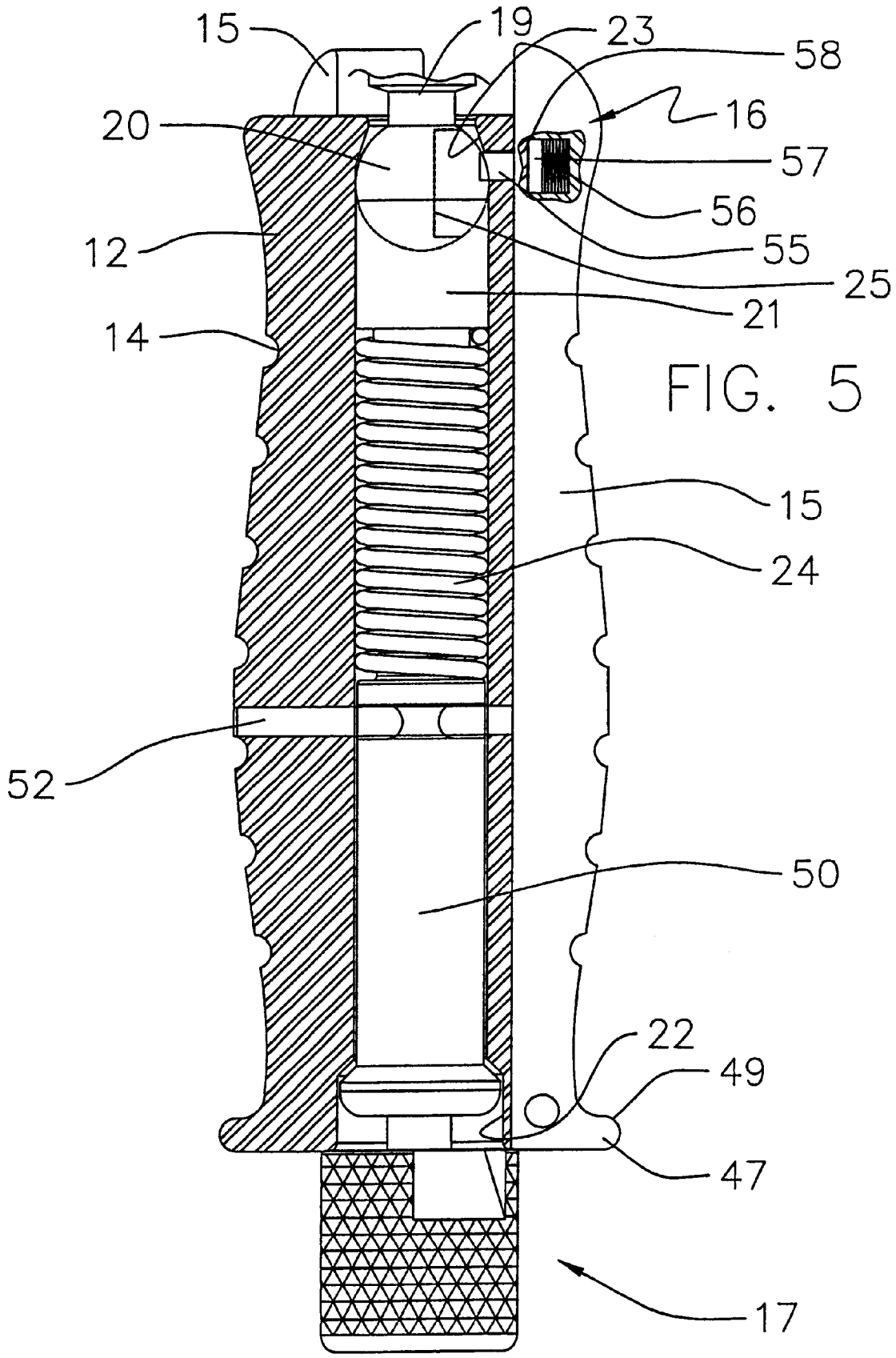
FIG. 5 is a partial cross-sectional view of the present invention.
Figure 6:
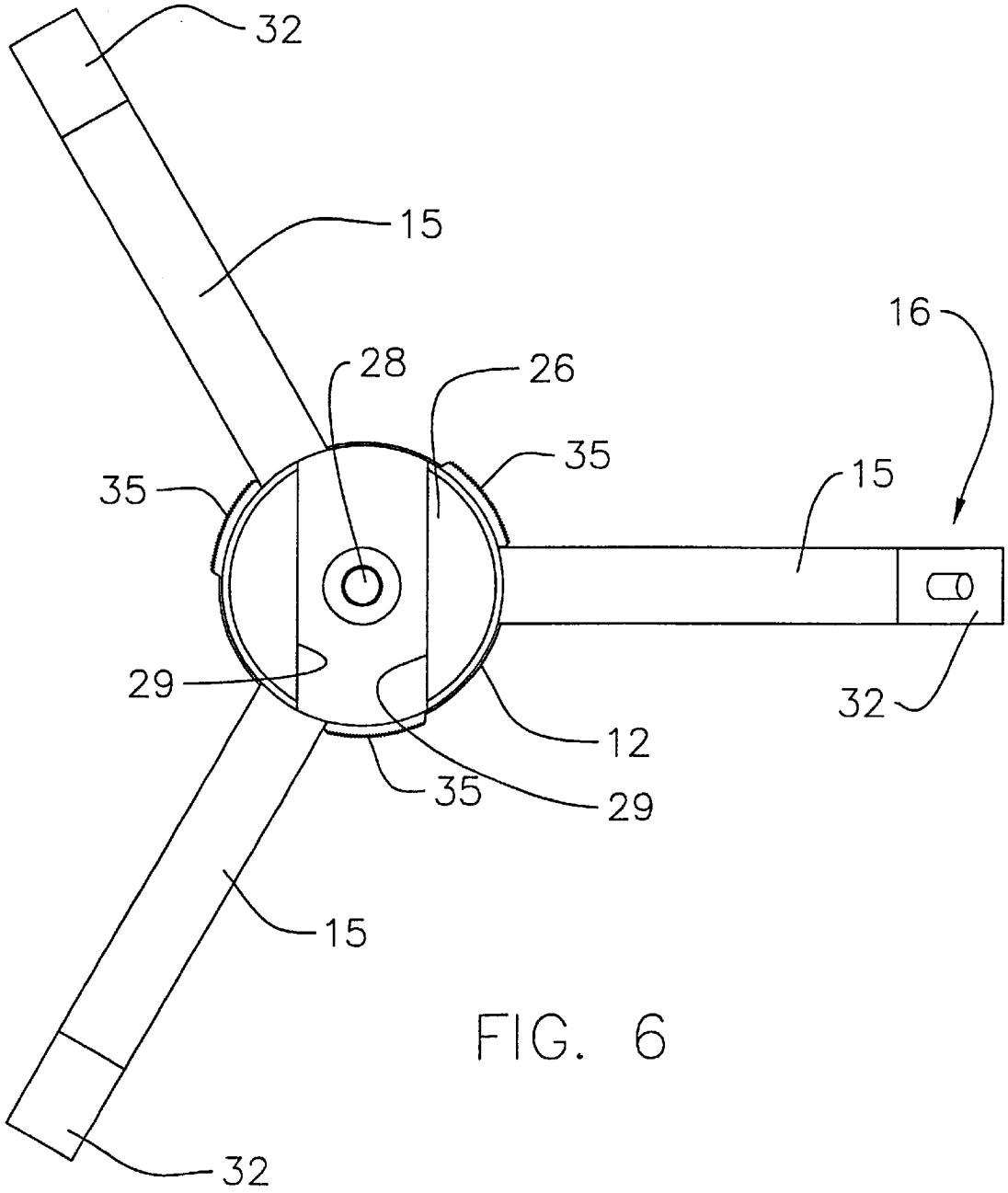
FIG. 6 is a plan view of the present invention.
Figure 7:
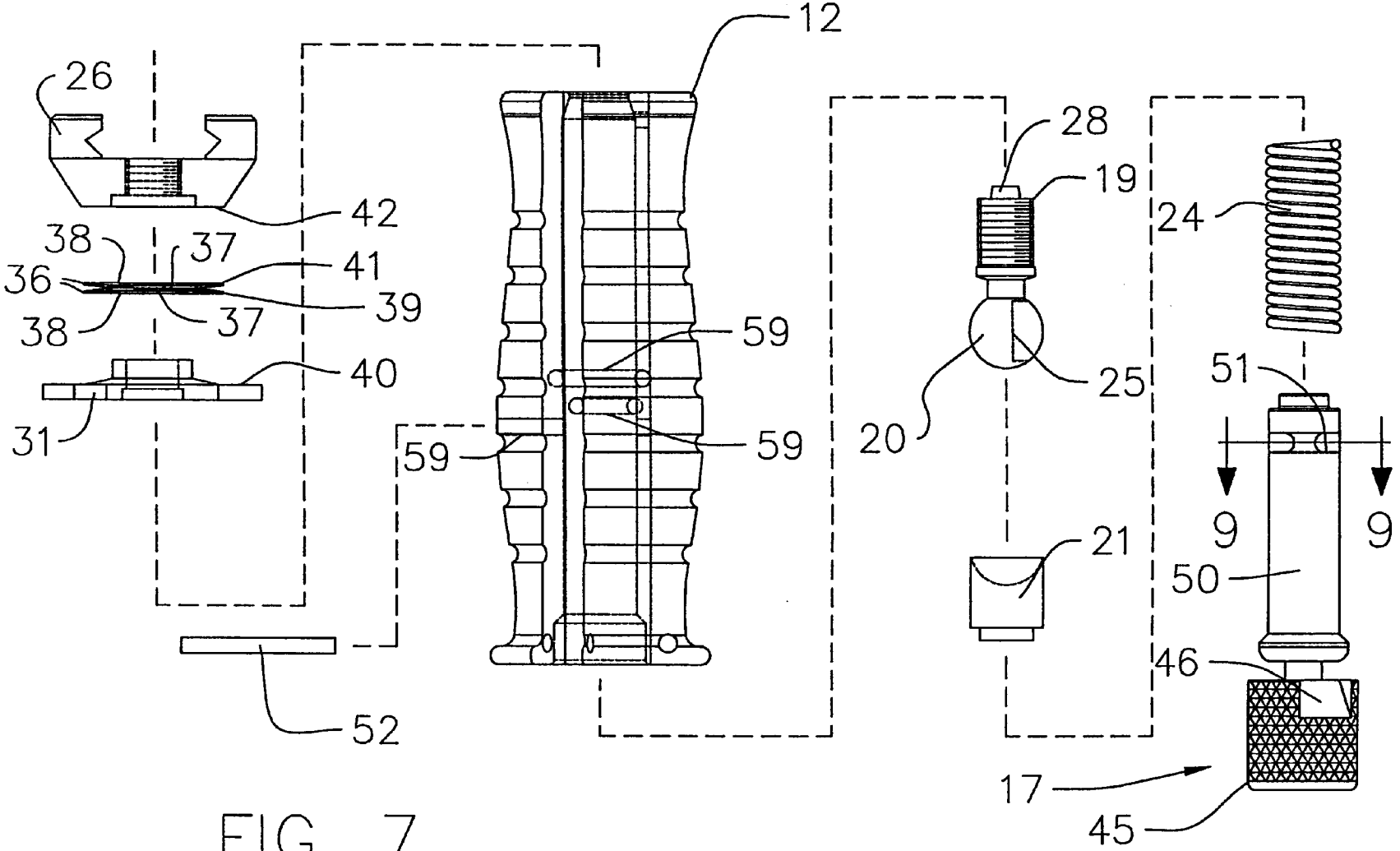
FIG. 7 is an exploded view of the present invention.

With reference now to the drawings, and in particular to FIGS. 1 through 10 thereof, a new tripod gun handle embodying the principles and concepts of the present invention and generally designated by the reference numeral 10 will be described.

As best illustrated in FIGS. 1 through 10, the tripod gun handle 10 generally comprises a mounting assembly 11 being designed for removably coupling to the gun. The tripod gun handle comprises and magnesium or aluminum for a light weight.

A handle portion 12 has a first end 13 being coupled to the mounting assembly 11. The handle portion 12 is designed for being gripped by a hand of a user when the mounting assembly 11 is coupled to the gun. The handle portion 12 is designed for stabilizing a barrel of a gun when the hand of the user grips the handle portion 12. The handle portion 12 includes a plurality of annular grooves 14 extending around a circumference of the handle portion 12 whereby each of the grooves 14 is designed for improving gripping of the handle portion 12 by the hand of the user further the grooves 14 reduce weight by removing unnecessary material. Further, the handle can comprise a composite material to further reduce the weight.

A plurality of legs 15 are hingably coupled to a second end 15 of the handle portion 12 opposite the mounting assembly 11 whereby each of the legs 15 are positionable into a deployed position wherein each of the legs 15 is designed for abutting a support surface for supporting the gun. The legs 15 are positionable into a storage position for facilitating transportation of the gun. An indexing pin assembly 16 is coupled to an end of one of the legs 15. The indexing pin assembly 16 has a pin portion 55 being biased outwardly from the one of the legs 15. A spring 56 is positioned between the leg 15 and the pin portion 55. A lip 57 of the pin portion 55 is for abutting a stopping lug 58 for preventing the pin portion 55 from being ejected from the leg 15.

A leg locking assembly 17 is coupled to the second end 15 of the handle portion 12. The leg locking assembly 17 is for selectively locking the legs 15 in the deployed position and in the storage position defined by the legs 15 being positioned within the handle portion 12. The handle portion 12 has a plurality of leg channels 18 extending between the first end 13 and the second end 15 of the handle portion 12. Each of the leg channels 18 is for receiving an associated one of the legs 15 when the associated leg is folded into the storage position.

The mounting assembly 11 includes a shaft 19 having a ball portion 20 coupled to the handle portion 12 such that the ball portion 20 provides rotatable and pivotal movement of the mounting assembly 11 relative to the handle portion 12 whereby the gun can be rotated through 360 degrees and pivoted with respect to the handle to provide the user with a greater field of fire. A ball seat 21 is positioned within a bore 22 of the handle portion 12 between the ball portion 20 of the mounting assembly 11 and the leg locking assembly 17. The ball seat 21 is for retaining the ball portion 20 against an upper wall 23 of the handle portion 12 for minimizing free rotation of the ball portion 20 with respect to the handle portion 12.

A biasing member 24 is positioned between the ball seat 21 and the leg locking assembly 17 for biasing the ball seat 21 away from the leg locking assembly 17 whereby contact is maintained between the ball seat 21 and the ball portion 20 of the mounting assembly 11.

The ball portion 20 of the mounting assembly 11 has an indexing channel 25. The indexing channel 25 is for receiving the pin portion 55 of the indexing pin assembly 16 whereby the mounting assembly 11 is prevented from rotating with respect to the handle portion 12 when the pin portion pin 55 is positioned in the indexing channel 25 of the mounting assembly 11.

The mounting assembly 11 includes a connection portion 26 threadably coupled to the shaft 19. The connection portion 26 has a mounting channel 27 designed for coupling to the barrel of the gun. The shaft 19 includes a locking nub 28. The locking nub 28 extends into the mounting channel 27 such that rotation of the shaft 19 with respect to the connection portion 26 adjusts a length of the locking nub 28 extending into the mounting channel 27 of the connection portion 26. The locking nub 28 is designed for abutting against a mounting portion of the barrel of the gun for enhancing frictional contact between the mounting portion of the barrel and the mounting channel 27 of the mounting portion to selectively prevent movement of the mounting assembly 11 with respect to the gun.

The mounting channel 27 has a pair of side walls 29. Each of the side walls 29 has an associated notch groove 30 extending along a length of the side walls 29. Each of the notch grooves 30 is designed for receiving a portion of the mounting portion the barrel of the gun whereby the portion of the barrel of the gun is forced against walls of the notch grooves 30 when the locking nub 28 abuts the portion of the barrel of the gun.

The mounting assembly 11 includes a disengagement cam 31 rotatably coupled to the shaft 19. The disengagement cam 31 engages a free end 32 of each of the legs 15 when the legs 15 are in the storage position whereby rotation of the disengagement cam 31 with respect to the shaft 19 forces the legs 15 to rotate away from the handle portion 12 into the deployed position. The disengagement cam 31 includes a plurality of cutouts 33. Each of the cutouts 33 is for engaging a selectable one of the legs 15. Each of the cutouts 33 has an engagement face 34 extending tangentially to the shaft 19. The engagement face 34 is for selectively abutting an interior face 34 of each of the legs 15 such that rotation of the disengagement cam 31 increases a distance between the shaft 19 and the interior face 34 of each of the legs 15 whereby the interior face 34 of each of the legs 15 is forced away from the handle portion 12. The disengagement cam 31 has a plurality of peripheral faces 35 each having knurling designed for increases traction of the disengagement cam 31 by the hand of the user when the user turns the disengagement cam 31.

A pair of washers 36 are positioned between the connection portion 26 and the disengagement cam 31. Each of the washers 36 has a substantially frusto-conical shape comprising a tapered end 37 and an abutting end 38. The abutting end 38 of a first of the washers 39 is for abutting against an upper face 40 of the disengagement cam 31. The abutting end 38 of a second of the washers 41 is for abutting against a bottom face 42 of the connection portion 26 whereby the tapered end 37 of the first of the washers 39 abuts the tapered end 37 of the second of the washer 41. The washers 36 push against the connection portion 26 and the disengagement cam 31 for minimizing free rotation of the disengagement cam 31 and the connection portion 26 with respect to the shaft 19.

Each of the cutouts 33 of the disengagement cam 31 has a stopping face 43 outwardly extending from the engaging face. The stopping face 43 of each of the cutouts 33 is for engaging a side face 44 of each of the legs 15 such that the stopping face 43 prevents rotation of the disengagement cam in a first direction whereby the disengagement cam 31 can be rotated only in a second direction to force the legs 15 away from the handle portion 12.

Figure 8:
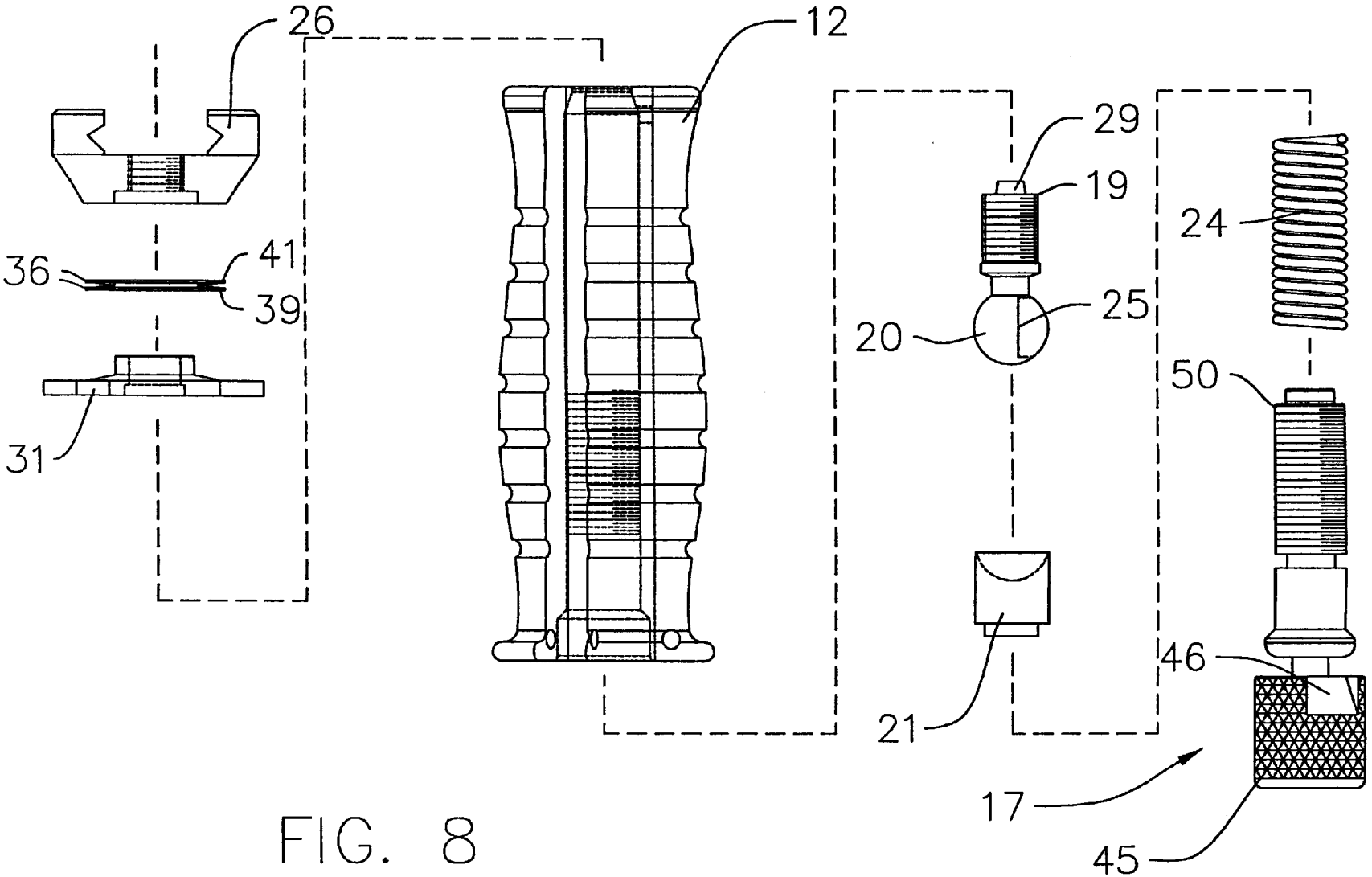
FIG. 8 is an exploded view of an embodiment of the present invention.
Figure 9:
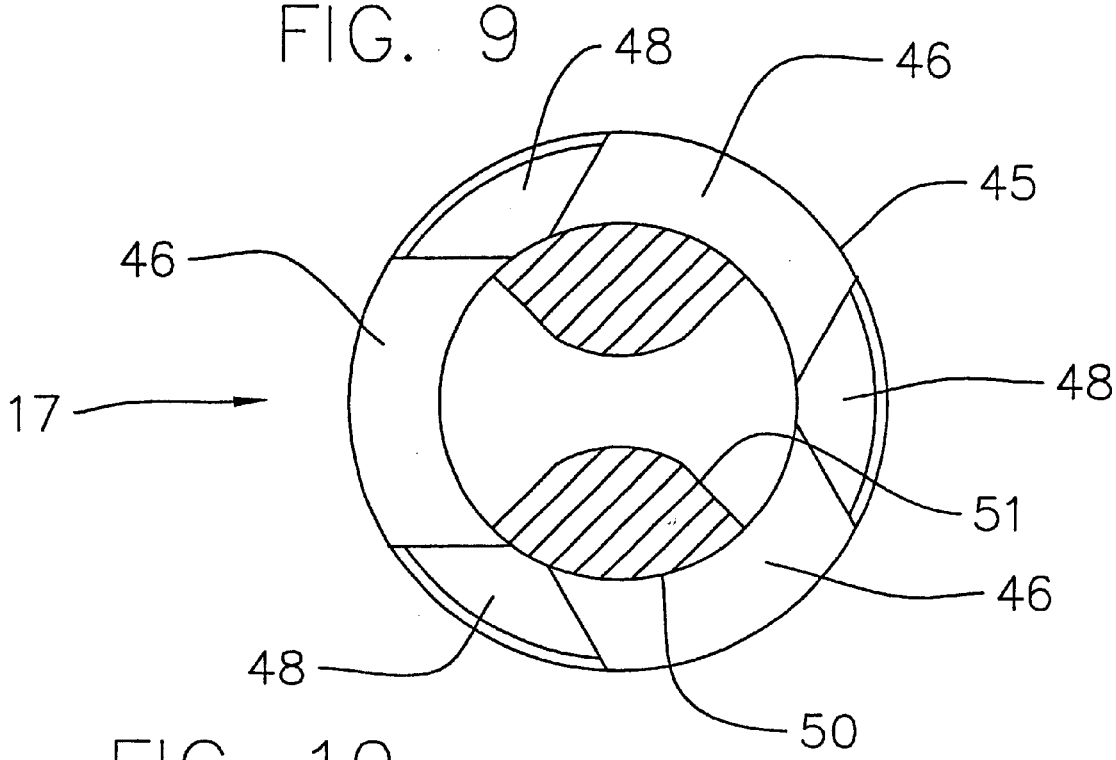
FIG. 9 is a cross-sectional view of the leg locking assembly the present invention taken along line, 9—9 of FIG. 7.
Figure 10:
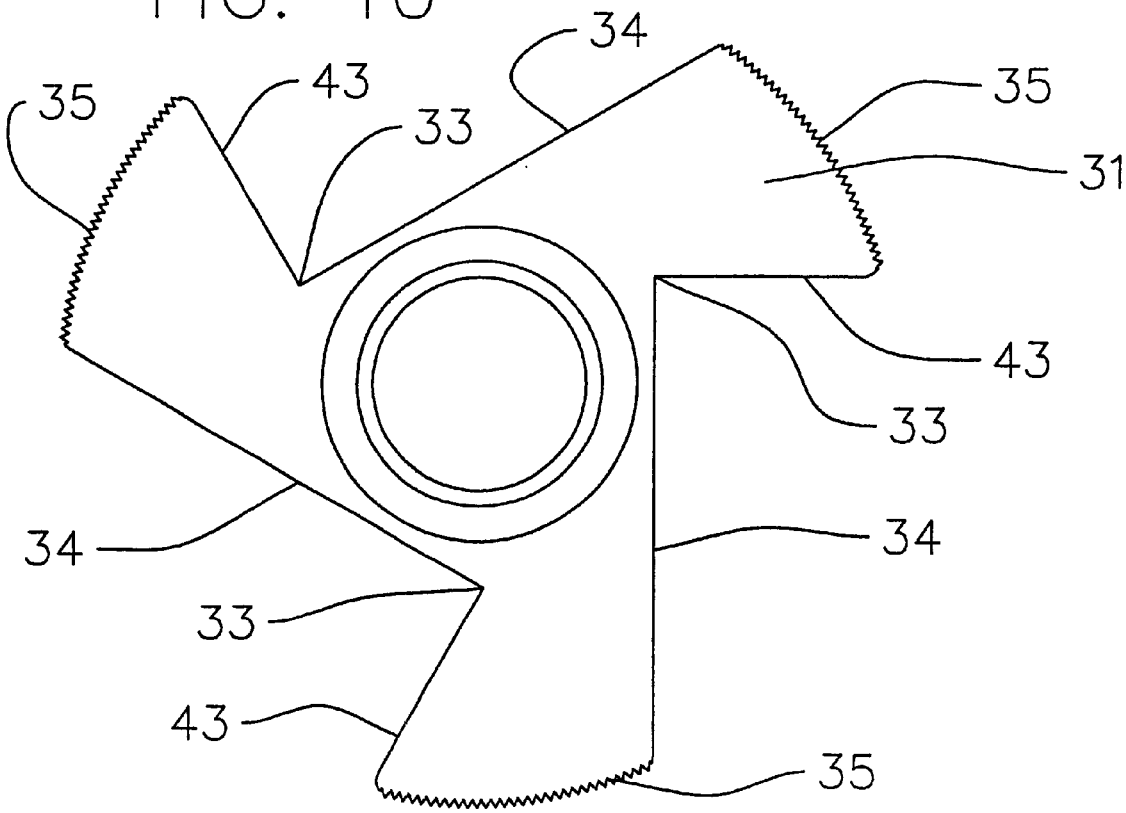
FIG. 10 is a plan view of the disengagement cam of the present invention.

The leg locking assembly 17 includes a bottom portion 45. The bottom portion 45 has a plurality of indentations 46. Each of the legs 15 has a tab 47 outwardly extending from each of the legs 15. A plurality of points 48 are each positioned between an adjacent pair of indentations 46 whereby each of the points 48 is for engaging a lower face 49 of the tab 47 of one of the legs 15 for preventing one of the legs 15 from being positioned in the storage position. The leg locking assembly 17 is rotatable whereby each of the indentations 46 is alignable with the tab 47 of one of the legs 15 for permitting rotation of the legs 15 to position the legs 15 in the storage position. The bottom portion 45 has a knurled surface for facilitating rotation of the leg locking assembly 17 by the hand of the user The leg locking assembly 17 has an upper portion 50 insertable into the handle portion 12. The upper portion 50 has a slot 51 for receiving a retaining pin 52 extending through the handle portion 12. The retaining pin 52 is for retaining the upper portion 50 of the leg locking assembly 17 within the handle portion 12. The slot 51 permits rotation of the leg locking assembly 17 for selectively locking the legs 15 in the deployed position when the retaining pin 52 retaining the leg locking assembly 17. In an embodiment, as shown in FIG. 8, the leg locking assembly 17 has an upper portion threadably insertable into the handle portion 12. The leg locking assembly 17 is rotatable for selectively adjusting the bottom portion 45 for engaging the tabs 47 of the legs 15 whereby the legs 15 are selectively locked in varying positions between the storage position and a fully deployed position for adjusting a height of the handle portion 12 above the support surface. In an embodiment, a plurality of retaining bores 59 are vertically spaced along a length of the handle portion 12 whereby the retaining pin 52 can be inserted into one of the retaining bores 59 and into the slot 51 of the leg locking assembly 17 for adjusting the height at which the legs 15 are locked into position.

In use, the user attaches the connection portion of the mounting assembly to the gun with the legs in the storage position. The indexing pin in the indexing channel permits the shaft to be rotated with respect to the connection portion forcing the locking nub against the gun to lock the connection portion to the gun. The user is then free to use the handle portion to stabilize the gun while firing. The user can then rotate the disengagement cam and force the legs into their deployed position. The leg locking assembly is rotated to lock the legs in the deployed position. The user can then place the legs on a support surface to support the gun and thereby increase accuracy. With the legs in the deployed position the indexing pin is removed from the indexing channel thereby leaving the gun free to rotated from side to side and pivoted up and down with respect to the handle portion.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A gun handle for mounting to a gun to stabilize the gun, the gun handle comprising:

a mounting assembly being adapted for removably coupling to the gun, said mounting assembly including a shaft having a ball portion;

a handle portion having a first end being coupled to said mounting assembly, said handle portion being adapted for being gripped by a hand of a user when said mounting assembly is coupled to the gun, said handle portion being adapted for stabilizing the barrel of a gun when the hand of the user grips said handle portion;

a plurality of legs being hingably coupled to a second end of said handle portion opposite said mounting assembly such that each of said legs are positionable into a deployed position wherein each of said legs is adapted for abutting a support surface for supporting the gun, said legs being positionable into a storage position for facilitating transportation of the gun;

a leg locking assembly coupled to said second end of said handle portion, said leg locking assembly being for selectively locking said legs in said deployed position and in said storage position defined by said legs being positioned within said handle portion;

a ball seat being positioned within a bore of said handle portion between said ball portion of said mounting assembly and said leg locking assembly, said ball seat being for retaining said ball portion against an upper wall of said handle portion for minimizing free rotation of said ball portion with respect to said handle portion;

an indexing pin assembly coupled to an end of one of said legs; said indexing pin assembly having a pin portion being biased outwardly from said one of said legs; and said ball portion of said mounting assembly having an indexing channel, said indexing channel being for receiving said pin portion whereby said mounting assembly is prevented from rotating with respect to said handle portion when said pin portion is positioned in said indexing channel of said mounting assembly.

2. The gun handle as set forth in claim 1, wherein said handle portion includes a plurality of annular grooves extending around a circumference of said handle portion whereby each of said grooves being adapted for improving gripping of said handle portion by the hand of the user.

3. The gun handle as set forth in claim 1, wherein said handle portion has a plurality of leg channels extending between said first end and said second end of said handle portion, each of said leg channels being for receiving an associated one of said legs when said associated leg is folded into said storage position.

4. The gun handle as set forth in claim 1, further comprising:

a ball seat being positioned within a bore of said handle portion between said ball portion of said mounting assembly and said leg locking assembly, said ball seat being for retaining said ball portion against an upper wall of said handle portion for minimizing free rotation of said ball portion with respect to said handle portion.

5. The gun handle as set forth in claim 4, further comprising:

a biasing member being positioned between said ball seat and said leg locking assembly for biasing said ball seat away from said leg locking assembly whereby contact is maintained between said ball seat and said ball portion of said mounting assembly.

6. The gun handle as set forth in claim 1, further comprising:

said mounting assembly including a connection portion threadably coupled to said shaft, said connection portion having a mounting channel adapted for coupling to the barrel of the gun, said shaft including a locking nub, said locking nub extending into said mounting channel such that rotation of said shaft with respect to said connection portion adjusts a length of said locking nub extending into said mounting channel of said connection portion, said locking nub being adapted for abutting against a mounting portion of the barrel of the gun for enhancing frictional contact between the mounting portion of the barrel and said mounting channel of said connection portion to selectively prevent movement of said mounting assembly with respect to the gun.

7. The gun handle as set forth in claim 6, wherein said mounting channel has a pair of side walls, each of said side walls having an associated notch groove extending along a length of said side walls, each of said notch grooves being adapted for receiving a portion of the mounting portion the barrel of the gun such that the portion of the barrel of the gun is forced against walls of said notch grooves when said locking nub abuts the portion of the barrel of the gun.

8. The gun handle as set forth in claim 1, wherein said mounting assembly includes a shaft;

said mounting assembly including a disengagement cam rotatably coupled to said shaft, said disengagement cam engaging a free end of each of said legs when said legs are in said storage position such that rotation of said disengagement cam with respect to said shaft forces said legs to rotate away from said handle portion into said deployed position.

9. The gun handle as set forth in claim 8, wherein said disengagement cam includes a plurality of cutouts, each of said cutouts being for engaging a selectable one of said legs, each of said cutouts having an engagement face extending tangentially to said shaft, said engagement face being for selectively abutting an interior face of each of said legs such that rotation of said disengagement cam increases a distance between said shaft and said interior face of each of said legs whereby said interior face of each of said legs is forced away from said handle portion.

10. The gun handle as set forth in claim 9, wherein each of said cutouts of said disengagement cam has a stopping face outwardly extending from said engaging face, said stopping face of each of said cutouts being for engaging a side face of each of said legs such that said stopping face prevents rotation of said disengagement cam in a first direction whereby said disengagement cam can be rotated only in a second direction to force the legs away from the handle portion.

11. The gun handle as set forth in claim 1, wherein said leg locking assembly includes a bottom portion, said bottom portion having a plurality of indentations, each of said legs having a tab outwardly extending from each of said legs, a plurality of points each being positioned between an adjacent pair of said indentations such that each of said points are for engaging a lower face of said tab of one of said legs for preventing one of said legs from being positioned in said storage position, said leg locking assembly being rotatable such that each of said indentations is alignable with said tab of one of said legs for permitting rotation of said legs to position said legs in said storage position.

12. The gun handle as set forth in claim 11, wherein said bottom portion has a knurled surface for facilitating rotation of said leg locking assembly by the hand of the user.

13. The gun handle as set forth in claim 11, wherein said leg locking assembly has an upper portion insertable into said handle portion, said upper portion having a slot for receiving a retaining pin extending through said handle portion, said retaining pin being for retaining said upper portion of said leg locking assembly within said handle portion, said slot permitting rotation of said leg locking assembly for selectively locking said legs in said deployed position when said retaining pin is retaining said leg locking assembly.

14. The gun handle as set forth in claim 11, wherein said leg locking assembly has an upper portion threadably insertable into said handle portion such that rotation of said leg locking assembly selectively adjusts said bottom portion for engaging said tabs of said legs whereby said legs are selectively locked in varying positions between said storage position and a fully deployed position for adjusting a height of said handle portion above said support surface.

15. A gun handle for mounting to a gun to stabilize the gun, the gun handle comprising:

a mounting assembly being adapted for removably coupling to the gun, a handle portion having a first end being coupled to said mounting assembly, said handle portion being adapted for being gripped by a hand of a user when said mounting assembly is coupled to the gun, said handle portion being adapted for stabilizing the barrel of a gun when the hand of the user grips said handle portion;

a plurality of legs being hingably coupled to a second end of said handle portion opposite said mounting assembly such that each of said legs are positionable into a deployed position wherein each of said legs is adapted for abutting a support surface for supporting the gun, said legs being positionable into a storage position for facilitating transportation of the gun;

a leg locking assembly coupled to said second end of said handle portion, said leg locking assembly being for selectively locking said legs in said deployed position and in said storage position defined by said legs being positioned within said handle portion;

said handle portion including a plurality of annular grooves extending around a circumference of said handle portion whereby each of said grooves being adapted for improving gripping of said handle portion by the hand of the user;

said handle portion having a plurality of leg channels extending between said first end and said second end of said handle portion, each of said leg channels being for receiving an associated one of said legs when said associated leg is folded into said storage position;

said mounting assembly including a shaft having a ball portion coupled to said handle portion such that said ball portion provides rotatable and pivotal movement of said mounting assembly relative to said handle portion;

a ball seat being positioned within a bore of said handle portion between said ball portion of said mounting assembly and said leg locking assembly, said ball seat being for retaining said ball portion against an upper wall of said handle portion for minimizing free rotation of said ball portion with respect to said handle portion;

a biasing member being positioned between said ball seat and said leg locking assembly for biasing said ball seat away from said leg locking assembly whereby contact is maintained between said ball seat and said ball portion of said mounting assembly;

an indexing pin assembly coupled to an end of one of said legs; said indexing pin assembly having a pin portion being biased outwardly from said one of said legs;

said ball portion of said mounting assembly having an indexing channel, said indexing channel being for receiving said pin portion whereby said mounting assembly is prevented from rotating with respect to said handle portion when said pin portion is positioned in said indexing channel of said mounting assembly;

said mounting assembly including a connection portion threadably coupled to said shaft, said connection portion having a mounting channel adapted for coupling to the barrel of the gun, said shaft including a locking nub, said locking nub extending into said mounting channel such that rotation of said shaft with respect to said connection portion adjusts a length of said locking nub extending into said mounting channel of said connection portion, said locking nub being adapted for abutting against a mounting portion of the barrel of the gun for enhancing frictional contact between the mounting portion of the barrel and said mounting channel of said connection portion to selectively prevent movement of said mounting assembly with respect to the gun;

said mounting channel having a pair of side walls, each of said side walls having an associated notch groove extending along a length of said side walls, each of said notch grooves being adapted for receiving a portion of the mounting portion the barrel of the gun such that the portion of the barrel of the gun is forced against walls of said notch grooves when said locking nub abuts the portion of the barrel of the gun;

said mounting assembly including a disengagement cam rotatably coupled to said shaft, said disengagement cam engaging a free end of each of said legs when said legs are in said storage position such that rotation of said disengagement cam with respect to said shaft forces said legs to rotate away from said handle portion into said deployed position;

said disengagement cam including a plurality of cutouts, each of said cutouts being for engaging a selectable one of said legs, each of said cutouts having an engagement face extending tangentially to said shaft, said engagement face being for selectively abutting an interior face of each of said legs such that rotation of said disengagement cam increases a distance between said shaft and said interior face of each of said legs whereby said interior face of each of said legs is forced away from said handle portion, said disengagement cam having a plurality of peripheral faces, each of said peripheral faces having knurling adapted for increases traction of said disengagement cam by the hand of the user when the user turns the disengagement cam;

a pair of washers positioned between said connection portion and said disengagement cam, each of said washers having a substantially frusto-conical shape comprising a tapered end and abutting end, said abutting end of a first of said washers being for abutting against an upper face of said disengagement cam, said abutting end of a second of said washer being for abutting against a bottom face of said connection portion such that said tapered end of said first of said washers abuts said tapered end of said second of said washer, said washers being for pushing against said connection portion and said disengagement cam for minimizing free rotation of said disengagement cam and said connection portion with respect to said shaft;

each of said cutouts of said disengagement cam having a stopping face outwardly extending from said engaging face, said stopping face of each of said cutouts being for engaging a side face of each of said legs such that said stopping face prevents rotation of said disengagement cam in a first direction whereby said disengagement cam can be rotated only in a second direction to force the legs away from the handle portion;

said leg locking assembly including a bottom portion, said bottom portion having a plurality of indentations, each of said legs having a tab outwardly extending from each of said legs, a plurality of points each being positioned between an adjacent pair of said indentations such that each of said points are for engaging a lower face of said tab of one of said legs for preventing one of said legs from being positioned in said storage position, said leg locking assembly being rotatable such that each of said indentations is alignable with said tab of one of said legs for permitting rotation of said legs to position said legs in said storage position;

said bottom portion having a knurled surface for facilitating rotation of said leg locking assembly by the hand of the user;

said leg locking assembly having an upper portion insertable into said handle portion, said upper portion having a slot for receiving a retaining pin extending through said handle portion, said retaining pin being for retaining said upper portion of said leg locking assembly within said handle portion, said slot permitting rotation of said leg locking assembly for selectively locking said legs in said deployed position when said retaining pin is retaining said leg locking assembly.

16. A gun handle for mounting to a gun to stabilize the gun, the gun handle comprising:

a mounting assembly being adapted for removably coupling to the gun, said mounting assembly including a shaft;

a handle portion having a first end being coupled to said mounting assembly, said handle portion being adapted for being gripped by a hand of a user when said mounting assembly is coupled to the gun, said handle portion being adapted for stabilizing the barrel of a gun when the hand of the user grips said handle portion;

a plurality of legs being hingably coupled to a second end of said handle portion opposite said mounting assembly such that each of said legs are positionable into a deployed position wherein each of said legs is adapted for abutting a support surface for supporting the gun, said legs being positionable into a storage position for facilitating transportation of the gun;

a leg locking assembly coupled to said second end of said handle portion, said leg locking assembly being for selectively locking said legs in said deployed position and in said storage position defined by said legs being positioned within said handle portion; and said mounting assembly including a connection portion threadably coupled to said shaft, said connection portion having a mounting channel adapted for coupling to the barrel of the gun, said shaft including a locking nub, said locking nub extending into said mounting channel such that rotation of said shaft with respect to said connection portion adjusts a length of said locking nub extending into said mounting channel of said connection portion, said locking nub being adapted for abutting against a mounting portion of the barrel of the gun for enhancing frictional contact between the mounting portion of the barrel and said mounting channel of said connection portion to selectively prevent movement of said mounting assembly with respect to the gun.

17. The gun handle as set forth in claim 16, wherein said mounting channel has a pair of side walls, each of said side walls having an associated notch groove extending along a length of said side walls, each of said notch grooves being adapted for receiving a portion of the mounting portion the barrel of the gun such that the portion of the barrel of the gun is forced against walls of said notch grooves when said locking nub abuts the portion of the barrel of the gun.

18. The gun handle as set forth in claim 16, wherein said mounting assembly includes a shaft;

said mounting assembly including a disengagement cam rotatably coupled to said shaft, said disengagement cam engaging a free end of each of said legs when said legs are in said storage position such that rotation of said disengagement cam with respect to said shaft forces said legs to rotate away from said handle portion into said deployed position.

19. The gun handle as set forth in claim 18, wherein said disengagement cam includes a plurality of cutouts, each of said cutouts being for engaging a selectable one of said legs, each of said cutouts having an engagement face extending tangentially to said shaft, said engagement face being for selectively abutting an interior face of each of said legs such that rotation of said disengagement cam increases a distance between said shaft and said interior face of each of said legs whereby said interior face of each of said legs is forced away from said handle portion.

20. The gun handle as set forth in claim 19, wherein each of said cutouts of said disengagement cam has a stopping face outwardly extending from said engaging face, said stopping face of each of said cutouts being for engaging a side face of each of said legs such that said stopping face prevents rotation of said disengagement cam in a first direction whereby said disengagement cam can be rotated only in a second direction to force the legs away from the handle portion.

21. The gun handle as set forth in claim 16, wherein said leg locking assembly includes a bottom portion, said bottom portion having a plurality of indentations, each of said legs having a tab outwardly extending from each of said legs, a plurality of points each being positioned between an adjacent pair of said indentations such that each of said points are for engaging a lower face of said tab of one of said legs for preventing one of said legs from being positioned in said storage position, said leg locking assembly being rotatable such that each of said indentations is alignable with said tab of one of said legs for permitting rotation of said legs to position said legs in said storage position.

22. The gun handle as set forth in claim 21, wherein said bottom portion has a knurled surface for facilitating rotation of said leg locking assembly by the hand of the user.

23. The gun handle as set forth in claim 21, wherein said leg locking assembly has an upper portion insertable into said handle portion, said upper portion having a slot for receiving a retaining pin extending through said handle portion, said retaining pin being for retaining said upper portion of said leg locking assembly within said handle portion, said slot permitting rotation of said leg locking assembly for selectively locking said legs in said deployed position when said retaining pin is retaining said leg locking assembly.

24. The gun handle as set forth in claim 21, wherein said leg locking assembly has an upper portion threadably insertable into said handle portion such that rotation of said leg locking assembly selectively adjusts said bottom portion for engaging said tabs of said legs whereby said legs are selectively locked in varying positions between said storage position and a fully deployed position for adjusting a height of said handle portion above said support surface.

25. A gun handle for mounting to a gun to stabilize the gun, the gun handle comprising:

a mounting assembly being adapted for removably coupling to the gun, handle portion having a first end being coupled to said mounting assembly, said handle portion being adapted for being gripped by a hand of a user when said mounting assembly is coupled to the gun, said handle portion being adapted for stabilizing the barrel of a gun when the hand of the user grips said handle portion;

a plurality of legs being hingably coupled to a second end of said handle portion opposite said mounting assembly such that each of said legs are positionable into a deployed position wherein each of said legs is adapted for abutting a support surface for supporting the gun, said legs being positionable into a storage position for facilitating transportation of the gun;

a leg locking assembly coupled to said second end of said handle portion, said leg locking assembly being for selectively locking said legs in said deployed position and in said storage position defined by said legs being positioned within said handle portion; and said mounting assembly including a shaft, said mounting assembly including a disengagement cam rotatably coupled to said shaft, said disengagement cam engaging a free end of each of said legs when said legs are in said storage position such that rotation of said disengagement cam with respect to said shaft forces said legs to rotate away from said handle portion into said deployed position.

26. The gun handle as set forth in claim 25, wherein said disengagement cam includes a plurality of cutouts, each of said cutouts being for engaging a selectable one of said legs, each of said cutouts having an engagement face extending tangentially to said shaft, said engagement face being for selectively abutting an interior face of each of said legs such that rotation of said disengagement cam increases a distance between said shaft and said interior face of each of said legs whereby said interior face of each of said legs is forced away from said handle portion.

27. The gun handle as set forth in claim 26, wherein each of said cutouts of said disengagement cam has a stopping face outwardly extending from said engaging face, said stopping face of each of said cutouts being for engaging a side face of each of said legs such that said stopping face prevents rotation of said disengagement cam in a first direction whereby said disengagement cam can be rotated only in a second direction to force the legs away from the handle portion.

28. The gun handle as set forth in claim 25, wherein said leg locking assembly includes a bottom portion, said bottom portion having a plurality of indentations, each of said legs having a tab outwardly extending from each of said legs, a plurality of points each being positioned between an adjacent pair of said indentations such that each of said points are for engaging a lower face of said tab of one of said legs for preventing one of said legs from being positioned in said storage position, said leg locking assembly being rotatable such that each of said indentations is alignable with said tab of one of said legs for permitting rotation of said legs to position said legs in said storage position.

29. The gun handle as set forth in claim 28, wherein said bottom portion has a knurled surface for facilitating rotation of said leg locking assembly by the hand of the user.

30. The gun handle as set forth in claim 28, wherein said leg locking assembly has an upper portion insertable into said handle portion, said upper portion having a slot for receiving a retaining pin extending through said handle portion, said retaining pin being for retaining said upper portion of said leg locking assembly within said handle portion, said slot permitting rotation of said leg locking assembly for selectively locking said legs in said deployed position when said retaining pin is retaining said leg locking assembly.

31. The gun handle as set forth in claim 28, wherein said leg locking assembly has an upper portion threadably insertable into said handle portion such that rotation of said leg locking assembly selectively adjusts said bottom portion for engaging said tabs of said legs whereby said legs are selectively locked in varying positions between said storage position and a fully deployed position for adjusting a height of said handle portion above said support surface.

32. A gun handle for mounting to a gun to stabilize the gun, the gun handle comprising:

a mounting assembly being adapted for removably coupling to the gun, a handle portion having a first end being coupled to said mounting assembly, said handle portion being adapted for being gripped by a hand of a user when said mounting assembly is coupled to the gun, said handle portion being adapted for stabilizing the barrel of a gun when the hand of the user grips said handle portion;

a plurality of legs being hingably coupled to a second end of said handle portion opposite said mounting assembly such that each of said legs are positionable into a deployed position wherein each of said legs is adapted for abutting a support surface for supporting the gun, said legs being positionable into a storage position for facilitating transportation of the gun;

a leg locking assembly coupled to said second end of said handle portion, said leg locking assembly being for selectively locking said legs in said deployed position and in said storage position defined by said legs being positioned within said handle portion; and said leg locking assembly including a bottom portion, said bottom portion having a plurality of indentations, each of said legs having a tab outwardly extending from each of said legs, a plurality of points each being positioned between an adjacent pair of said indentations such that each of said points are for engaging a lower face of said tab of one of said legs for preventing one of said legs from being positioned in said storage position, said leg locking assembly being rotatable such that each of said indentations is alignable with said tab of one of said legs for permitting rotation of said legs to position said legs in said storage position.

33. The gun handle as set forth in claim 32, wherein said bottom portion has a knurled surface for facilitating rotation of said leg locking assembly by the hand of the user.

34. The gun handle as set forth in claim 32, wherein said leg locking assembly has an upper portion insertable into said handle portion, said upper portion having a slot for receiving a retaining pin extending through said handle portion, said retaining pin being for retaining said upper portion of said leg locking assembly within said handle portion, said slot permitting rotation of said leg locking assembly for selectively locking said legs in said deployed position when said retaining pin is retaining said leg locking assembly.

35. The gun handle as set forth in claim 32, wherein said leg locking assembly has an upper portion threadably insertable into said handle portion such that rotation of said leg locking assembly selectively adjusts said bottom portion for engaging said tabs of said legs whereby said legs are selectively locked in varying positions between said storage position and a fully deployed position for adjusting a height of said handle portion above said support surface.

* * * * *